US008722300B2

(12) United States Patent
Joo et al.

(10) Patent No.: US 8,722,300 B2
(45) Date of Patent: May 13, 2014

(54) ELECTROPHOTOGRAPHIC TONER AND METHOD OF PREPARING THE SAME

(75) Inventors: Hae-Ree Joo, Anyang-si (KR); Jae-Hyeuk Jeong, Suwon-si (KR); Kyeong Pang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 511 days.

(21) Appl. No.: 12/488,925

(22) Filed: Jun. 22, 2009

(65) Prior Publication Data

US 2009/0324296 A1 Dec. 31, 2009

(30) Foreign Application Priority Data

Jun. 23, 2008 (KR) ..... 10-2008-0059059
Jun. 9, 2009 (KR) ..... 10-2009-0051062

(51) Int. Cl.
*G03G 9/00* (2006.01)

(52) U.S. Cl.
USPC ..... 430/110.3; 430/137.14

(58) Field of Classification Search
USPC ..... 430/137.14, 110.3
See application file for complete search history.

(56) References Cited

U.S. PATENT DOCUMENTS

2004/0162373 A1* 8/2004 Cheng et al. ..... 524/392
2006/0283806 A1* 12/2006 Kojima et al. ..... 210/725
2007/0087281 A1* 4/2007 Patel et al. ..... 430/110.2
2008/0166649 A1* 7/2008 Moffat et al. ..... 430/108.8
2009/0111038 A1* 4/2009 Shin et al. ..... 430/48

* cited by examiner

*Primary Examiner* — Thorl Chea
(74) *Attorney, Agent, or Firm* — Stanzione & Kim, LLP

(57) ABSTRACT

Disclosed are an electrophotographic toner and a method of preparing the same. The electrophotographic toner includes latex; a colorant; and a releasing agent. The absolute value of a differential value of complex viscosity with respect to temperature, $$\left(\left|\frac{d\eta}{dT}\right|\right)|d(\log_{10}\eta)/dT|$$

of the electrophotographic toner in a temperature range of 100° C.-160° C. is in a range of about 0.03 to about 0.06, and complex viscosity (η) of the electrophotographic toner at 140° C. is in a range of about $1.0\times10^2$ Pa·s to about $6.0\times10^2$ Pa·s.

10 Claims, 4 Drawing Sheets

ELECTROPHOTOGRAPHIC TONER AND METHOD OF PREPARING THE SAME

CROSS-REFERENCE TO RELATED PATENT APPLICATIONS

This application claims the priority under 35 U.S.C. §119 from two Korean Patent Application Nos. 10-2008-0059059, filed on Jun. 23, 2008 and 10-2009-0051062, filed on Jun. 9, 2009, respectively, in the Korean Intellectual Property Office, the disclosures of both of which are incorporated herein by reference in their entirety.

TECHNICAL FIELD

The present disclosure relates generally to toner, and more particularly to an electrophotographic toner and method of preparing the same. The toner consistent with aspects of the present disclosure enables smaller particle diameters, a narrower particle diameter distribution, low-temperature fixing characteristics and/or rheological characteristics optimized to obtain high-gloss and high-quality images.

BACKGROUND OF RELATED ART

Electrophotographic techniques and electrostatic recording techniques use developers that make electrostatic images or electrostatic latent images visible. Developers can be categorized as either two-component developers or one-component developers. Two-component developers include toner and carrier particles. One-component developers include only toner. One-component developers can be sub-categorized into magnetic developers that contain a magnetic component and non-magnetic developers that do not contain a magnetic component. Non-magnetic one-component developers generally include a fluidizer to increase fluidity of toner, which may be colloidal silica.

In general, "toner" refers to color particles that are prepared by dispersing a pigment and additives in latex and by forming the dispersion product into particles. The pigment can be carbon black. Toner can be prepared using a grinding method or a polymerizing method. In the grinding method, a synthesized resin, a pigment, and if necessary, additives, are dissolved and mixed. The mixture is ground and the resultant particles are classified as having a desired diameter. In the polymerizing method, a polymerizable monomer, a pigment a polymerization initiator, and if necessary, additives, such as a crosslinking agent or an antistatic agent, are homogeneously dissolved or dispersed to form a polymerizable monomer composition. The polymerizable monomer composition is dispersed with an agitator in an aqueous dispersion medium containing a dispersion stabilizer so as to form droplet particles of the polymerizable monomer composition. The temperature is then increased and a suspension-polymerization process is performed thereon to obtain color polymerization particles having desired particle diameters or polymerization toner.

Image forming apparatuses such as an electrophotographic apparatus or an electrostatic recording apparatus, form an image using the following method. First, a homogeneously charged photoreceptor is exposed to light and a latent image is thus formed Then, toner is attached to the latent image to form a toner image. The toner image is transferred to a transfer medium such as a transfer sheet. Then, the "un-fixed" toner image is fixed onto the transfer medium by, for example, heating, pressing, or solvent evaporating. In the fixing process in general, the transfer medium, to which the toner image is transferred, passes between a fixing roll and a pressing roll. Toner on the toner image is heated and pressed, which fuses the toner image onto the transfer medium.

Some image forming apparatuses, such as electrical photocopiers, need to have accurate and precise image forming characteristics. Conventionally, toner used in an image forming apparatus has been prepared using the grinding method. However, toner particles obtained from the grinding method have a wide particle-diameter distribution. Therefore, to obtain appropriate development characteristics, toner particles should be classified to reduce the particle-diameter distribution. However, when toner particles for an electrophotographic technique or an electrostatic technique are prepared using conventional mixing and grinding processes, it is difficult to accurately control particle diameters and the distribution of particle diameters. The yield of small particles is low due to the need for the classification process. In addition, there are limitations on modifying or adjusting the toner design for improving charging and fixing characteristics.

For toner prepared by the polymerization process, particle diameters can be easily controlled, and complex processes, such as a classifying, are not used. As described above, when toner is prepared using a polymerizing process, toner having desirable particle diameters and desirable particle-diameter distribution can be obtained without grinding or the classifying process. However, polymerization toner should still have fixing characteristics and durability to obtain desired printing performance and high image quality. To this end, there is a need for toner having optimized rheological characteristics.

SUMMARY OF DISCLOSURE

Described is an electrophotographic toner including: latex; a colorant and a releasing agent. The absolute value of a differential value of the $\log_{10}$ of complex viscosity ($\eta$) with respect to a differential value of temperature, that is, $$\left|\frac{d\eta}{dT}\right| |d(\log_{10}\eta)/dT|$$

of the electrophotographic toner in a temperature range of 100° C.-160° C. is in a range of about 0.03 to about 0.06. Complex viscosity ($\eta$) of the electrophotographic toner at 140° C. is in a range of about $1.0\times10^2$ Pa·s to about $6.0\times10^2$ Pa·s. The disclosure describes an electrophotographic toner having a viscosity in a temperature range of a fixing condition, and which can thus be fixed to form high-gloss images.

Also disclosed is a method of preparing an electrophotographic toner, the method including: mixing primary latex, a pigment-dispersed solution and a releasing agent-dispersed solution; adding an aggregating agent to the mixture so as to prepare once-agglomerated toner; and coating the once-agglomerated toner with secondary latex prepared by polymerizing at least one polymerizable monomer so as to prepare twice-agglomerated toner. The absolute value of the $\log_{10}$ of complex viscosity ($\eta$) with respect to a differential value of temperature, that is, $$\left|\frac{d\eta}{dT}\right| |d(\log_{10}\eta)/dT|$$

of the electrophotographic toner in a temperature range of 100° C.-160° C. is in a range of about 0.03 to about 0.06.

Complex viscosity (η) of the electrophotographic toner at 140° C. is in a range of about $1.0\times10^2$ Pa·s to about $6.0\times10^2$ Pa·s.

Also disclosed is an image forming method including: attaching the electrophotographic toner to a surface of a photoreceptor on which a latent image is formed; and transferring the toner image to a transfer medium.

Also disclosed is a cartridge including: the electrophotographic toner; and a housing containing the toner.

Also disclosed is an apparatus for forming an image using the electrophotographic toner, the apparatus comprising a transferring unit for transferring a print medium.

BRIEF DESCRIPTION OF THE DRAWINGS

The above and other features and advantages of the disclosure will become more apparent by describing in detail, forms thereof, with reference to the attached drawings in which.

DETAILED DESCRIPTION OF SEVERAL EMBODIMENTS

Figure 1:
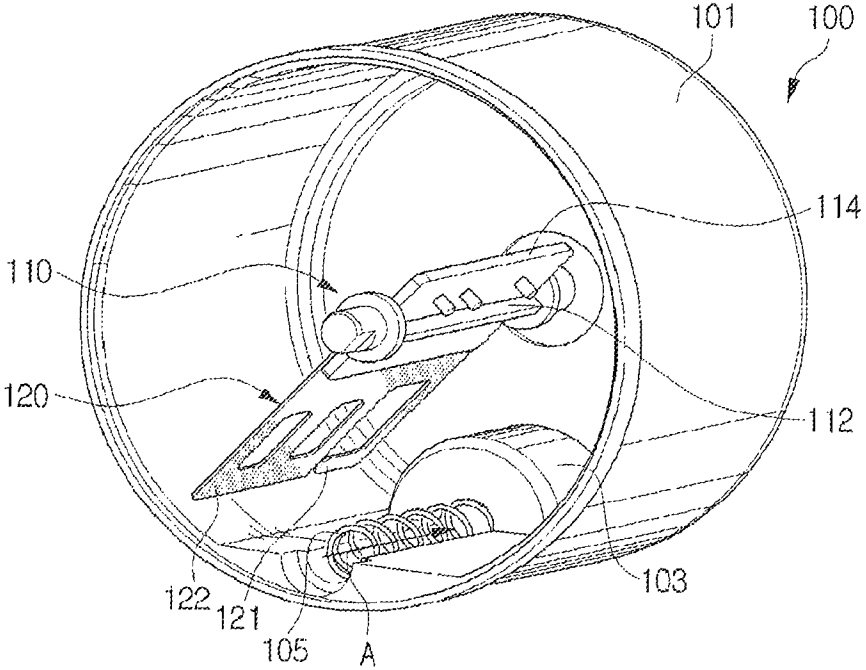
FIG. 1 is a perspective view of a cartridge.

The disclosure will now be described more fully with reference to the accompanying drawings.

An electrophotographic toner includes latex, a colorant, and a releasing agent. The absolute value of a differential value of the $\log_{10}$ of complex viscosity with respect to a differential value of temperature, that is, $$\left|\frac{d\eta}{dT}\right| |d(\log_{10}\eta)/dT|$$

of the electrophotographic toner, in a temperature range of about 100° C. to about 160° C., is in a range of about 0.03 to about 0.06, and complex viscosity (η) of the electrophotographic toner at 140° C. is in a range of about $1.0\times10^2$ Pa·s to about $6.0\times10^2$ Pa·s.

In general, toner is exposed to various temperatures and pressures in a developing unit and a fixing unit. Viscosity affects whether toner has the desired durability and fixing ability. Viscosity is measured after the viscous composition is homogeneously mixed. However, with regard to a viscoelastic composition such as toner, in which wax and pigment are dispersed, it is important to keep wax and pigment uniformly dispersed when measuring viscosity of the viscoelastic composition. Accordingly, toner is evaluated based on complex viscosity. Complex viscosity is expressed using the following equation:

$$\text{Complex viscosity } (\eta)=(G'^2+G''^2)^{1/2}/w$$

where G': storage modulus (Pa), G": loss modulus (Pa), and w: angular velocity (rad/s).

According to an embodiment of the present disclosure, the complex viscosity may be measured using a temperature-distribution evaluation method in which a sine-wave vibration is used at an angular velocity (vibration frequency number) of 6.28 rad/s in a temperature range of room temperature (i.e., 20° to 25° C.) to 180° C. The complex viscosity can be measured with an ARES rheometer manufactured by Rheometric Scientific Co. The angular velocity of 6.28 rad/s is determined in consideration of a fixing speed of a conventional fixing device.

In addition, as described above, the complex viscosity is measured in the temperature range of 100-160° C. The temperature range is determined in consideration of a fixing temperature range of a heating roller, that is, 160-200° C. When toner is fixed in a fixing condition of the heating roller, not all of the heat of the heating roller may transfer to the toner or a predetermined amount of heat may be needed to increase the temperature of the toner itself. Therefore, the complex viscosity measurement temperature range is about 20 to about 40° C. lower than the temperature range of the fixing roller itself.

In general, complex viscosity is dependent upon temperature and angular velocity. In particular, complex viscosity is inversely proportional to temperature and angular velocity. That is, when temperature and angular velocity are high, the complex viscosity is low. On the other hand, when temperature and angular velocity are low, the complex viscosity is high. If the complex viscosity is less than about $1.0\times10^2$ Pa·s, a cohesive force of toner may be too low, and an offset phenomenon may occur at high temperature. On the other hand, if the complex viscosity is greater than about $6.0\times10^2$, the cohesive force of toner may be too high and thus, an adhesive force between an image forming medium and toner is less than an adhesive force between toner and a development roller. Therefore, an offset phenomenon occurs, or due to an unstably fixed image, the final fixed image has low surface gloss and poor fixing characteristics.

In addition, with respect to viscosity behavior of toner, both a viscosity range in a temperature range of 100° C.-160° C. and the absolute value of a differentiated value of complex viscosity with respect to temperature, that is, $$\left|\frac{d\eta}{dT}\right| |d(\log_{10}\eta)/dT|$$

affect image quality. That is, in a temperature range of 100° C.-160° C., the differential value (d ($\log_{10}\eta$)/dT) of complex viscosity with respect to temperature is a tangent gradient of a plot of complex viscosity of toner with respect to temperature. By using the differential value, appropriate toner characteristics that are required to obtain a high-quality image can be identified.

$$\left|\frac{d\eta}{dT}\right| |d(\log_{10}\eta)/dT|$$

of the electrophotographic toner may be about 0.03 or more, specifically in a range of about 0.03 to about 0.06.

If the $$\left|\frac{d\eta}{dT}\right| |d(\log_{10}\eta)/dT|$$

of the electrophotographic toner is less than 0.03, sufficient gloss and fixing may not be obtained. On the other hand, if the $$\left|\frac{d\eta}{dT}\right| |d(\log_{10}\eta)/dT|$$

of the electrophotographic toner is greater than about 0.06, an offset phenomenon or lab jamming may occur and, thus, uniform images cannot be obtained.

Behavior and fluidity characteristics of toner at a temperature at which loss tangent (tan δ), that is, G"/G' (a ratio of loss modulus G" to storage modulus G') of toner has a local minimum value, can be predicted.

The local minimum value of loss tangent of toner refers to a value of loss tangent in a position in a plot of temperature and loss tangent, where a differential value of loss tangent with respect to temperature is "0" and a secondary differential value is equal to or greater than 0.

Figure 3:
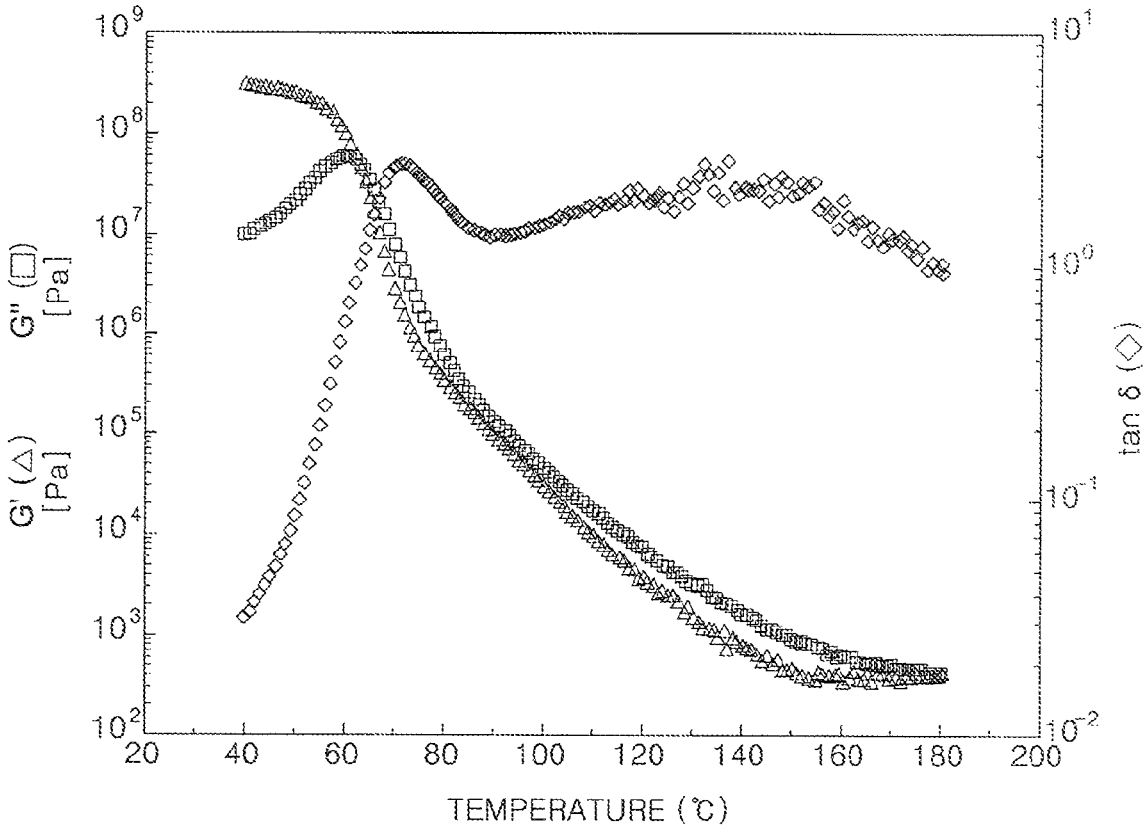
FIG. 3 is a graph of storage/loss modulus and loss tangent with respect to the temperature of toner prepared according to Example 1.

For example, referring to FIG. 3 that is a graph of storage/loss modulus and loss tangent with respect to the temperature of toner prepared according to an embodiment of the present disclosure, the value of loss tangent is substantially increased between the temperatures of about 40° C. and 70° C. before becoming reduced, and after about 90° C., is increased again. In this regard, at a temperature of about 90° C., a temperature at which loss tangent is decreased and then increased again, that is, the differential value of loss tangent with respect to temperature is 0, and the loss tangent has a local minimum value.

The temperature at which loss tangent (tan δ) of toner has a local minimum value may be in a range of about 80° C. to about 90° C. If the temperature is less than about 80° C., the toner may not be durable. On the other hand, if the temperature is greater than about 90° C., sufficient gloss or a fixing effect cannot be obtained.

At the temperature at which loss tangent (tan δ) of toner has a local minimum value, the complex viscosity of toner may be, for example, about $1.0\times10^4$ Pa·s to about $4.0\times10^4$ Pa·s. Preferably, viscosity is about $2.0\times10^4$ to about $3.5\times10^4$ Pa·s. If the complex viscosity of toner is less than $1.0\times10^4$ Pa·s, the toner may not be sufficiently durable. On the other hand, if the complex viscosity of the toner is greater than about $4.0\times10^4$ Pa·s, the rigidity of toner may be too high, and the toner cannot be used in low-temperature fixing or high-speed fixing.

At the temperature at which loss tangent (tan δ) of toner has a local minimum value, the activation energy of the toner may be, for example, about 170 KJ/mol or more, specifically in a range of about 170 to about 200 KJ/mol.

In general, the activation energy of toner is a value indicating the level of sensitivity of viscosity with respect to temperature. In other words, activation energy of toner indicates the dependency of viscosity on temperature. The activation energy of toner can be measured using the Arrhenius Equation or the Williams, Landel, and Ferry (WLF) Equation. These equations can be appropriately used according to $T_g$ of a sample and a temperature. The viscosity and activation energy of toner can be measured using the Arrhenius Equation expressed using Equation 1:

$$\eta(T)=\eta(T_0)\mathrm{Exp}[U/R(1/T-1/T_0)] \qquad \text{Equation 1}$$

where η is viscosity, T is temperature, $T_0$ is a reference temperature, U is activation energy, and R is a gas constant. If the activation energy of the toner is less than about 170 KJ/mol, sufficient gloss or fixing may not be obtained. On the other hand, if the activation energy of the toner is greater than about 200 KJ/mol, an offset phenomenon or lab jamming may occur and, thus, uniform images cannot be obtained.

In addition, at a temperature at which a secondary differential value of complex viscosity with respect to temperature, that is, $(d^2(\log_{10}\eta)/(dT)^2)$ is minimal, the complex viscosity of toner may be, for example, about $3.0\times10^7$ Pa·s or more, specifically in a range of about $3.0\times10^7$ to about $5.0\times10^7$ Pa·s.

The secondary differential value $(d^2(\log_{10}\eta)/(dT)^2)$ is a change rate of a tangent gradient of a plot of the complex viscosity of toner with respect to temperature. The temperature at which the secondary differential value $(d^2(\log_{10}\eta)/(dT)^2)$ is minimal is, in general, a temperature at a point of inflection at which the complex viscosity of toner starts to change. Accordingly, at the temperature at which the secondary differential value $(d^2(\log_{10}\eta)/(dT)^2)$ is minimal, rigidity of toner at low temperature, that is durability of toner, can be indirectly predicted through a temperature range in which complex viscosity of toner changes and complex viscosity values in the temperature range.

The temperature at which the secondary differential value $(d^2(\log_{10}\eta)/(dT)^2)$ is minimal is, for example, about 50° C. or more, specifically in a range of about 50° C. to about 70° C. If the complex viscosity of toner at the temperature at which the secondary differential value $(d^2(\log_{10}\eta)/(dT)^2)$ is minimal is less than about $3.0\times10^7$ Pa·s, the durability of the toner may be lowered, it may form streaks, and storage stability may be degraded.

A method of preparing an electrophotographic toner may include: mixing primary latex, a pigment-dispersed solution, and a releasing agent-dispersed solution; adding an aggregating agent to the mixture so as to prepare once-agglomerated toner; and coating the once-agglomerated toner with secondary latex prepared by polymerizing at least one polymerizable monomer so as to prepare twice-agglomerated toner.

$$\left|\frac{d\eta}{dT}\right| |d(\log_{10}\eta)/dT|$$

of the electrophotographic toner in a temperature range of 100° C.-160° C. is in a range of about 0.03 to about 0.06, and complex viscosity (η) of the electrophotographic toner at 140° C. is in a range of about $1.0\times10^2$ Pa·s to about $6.0\times10^2$ Pa·s.

Examples of the aggregating agent include NaCl, $MgCl_2$, $MgCl_2.8H_2O$, $[Al_2(OH)_nCl_{6-n}]_m$ $Al_2(SO_4)_3.18H_2O$, polyaluminum chloride (PAC), polyaluminum sulfate (PAS), polyaluminum sulfate silicate (PASS), ferrous sulfate, ferric sulfate, ferric chloride, slaked lime, potassium carbonate, and Si and Fe-containing metal salt. However, the aggregating agent is not limited to the compounds described above.

The amount of the aggregating agent is, for example, in a range of about 3 to about 16 parts by weight, specifically about 5 to about 12 parts by weight, based on 100 parts by weight of the primary latex. If the amount of the aggregating agent is less than about 3 parts by weight based on 100 parts by weight of the primary latex, agglomeration efficiency may be decreased. On the other hand, if the amount of the aggregating agent is greater than about 16 parts by weight based on 100 parts by weight of the primary latex, toner may not be easily charged.

The electrophotographic toner may be prepared using a Si and Fe-containing metal salt as an aggregating agent. In this case, the amount of the Si and Fe-containing metal salt is controlled such that the amount of Fe in the electrophotographic toner is in a range of about 50 to about 10,000 ppm. If the amount of Fe is less than about 50 ppm, target effects may not be obtained. On the other hand, if the amount of Fe is greater than about 10,000 ppm, toner may not be easily charged.

The Si and Fe-containing metal salt may include polysilica iron. Use of the Si and Fe-containing metal salt in the process of manufacturing toner leads to an increase in ionic strength and frequent collision of particles. Thus, sizes of once-agglomerated toner particles may increase. Examples of polysilica iron include PSI-025, PSI-050, PSI-075, PSI-100, PSI-200, and PSI-300 (Suido Kiko Kaisha, Ltd). Characteristics and compositions of PSI-025, PSI-050, PSI-075, PSI-100, PSI-200, and PSI-300 are shown in Table 1.

TABLE 1

| Type | | PSI-025 | PSI-050 | PSI-075 | PSI-100 | PSI-200 | PSI-300 |
|---|---|---|---|---|---|---|---|
| Silica/Fe mole ratio(Si/Fe) | | 0.25 | 0.5 | 0.75 | 1 | 2 | 3 |
| Concentration of major components | Fe (wt %) | 5.0 | 3.5 | 5.0 | 2.0 | 1.0 | 0.7 |
| | $SiO_2$ (wt %) | 1.4 | 1.9 | 1.4 | | 2.2 | |
| PH (1 w/v %) | | | | 2-3 | | | |
| Specific Gravity (20° C.) | | 1.14 | 1.13 | 1.09 | 1.08 | 1.06 | 1.04 |
| Viscosity (mPa · S) | | | | 2.0 or more | | | |
| Average Molecular Weight (Dalton) | | | | 500,000 | | | |
| Appearance | | | | Transparent yellowish brown liquid | | | |

Due to Si and Fe-containing metal salt in an embodiment of the present general inventive concept, small toner particles can be formed and the shape of the toner particles can be controlled.

Accordingly, the electrophotographic toner according to an embodiment of the present general inventive concept has a volume average particle diameter of about 3 to about 9 μm and an average circularity of about 0.940 to about 0.980 μm.

In general, small toner particles are suitable for high resolution and a high-quality image, but may be unsuitable for transferring and washing. That is, small toner particles require a long transferring time. It is important to adjust the diameter of toner particles to be in an appropriate range.

The volume average particle diameter of toner may be measured using a light scattering technique. If the volume average particle diameter of toner is less than about 3 μm, a photoreceptor on which the toner is applied may be incompletely cleaned, mass-production yield may be low, and such toner is harmful due to scattering. On the other hand, if the volume average particle diameter of toner is greater than about 9 μm, resolution and image quality may be low, toner may be non-uniformly charged, fixing characteristics of the toner may be degraded, and a layer of toner cannot be controlled with a doctor blade.

If the average circularity of toner is less than 0.940, an image layer formed on a transfer medium may be thick, pores between toner particles may be too big and, thus, an image formed on the transfer medium has insufficient coverage rate and toner consumption must be increased to obtain a desirable image concentration. On the other hand, if the average circularity of toner is greater than 0.980, excess toner is provided onto a development sleeve. Thus, toner is non-uniformly coated on the development sleeve and contamination may occur.

The circularity of toner can be measured using 50 toner particles selected from a scanning electron microscopic (SEM) image of toner and software for quantifying an image based on an evaluation equation below. The software for quantifying an image may be software Image J or software 1.33u (National Institutes of Health, USA).

Evaluation Equation $$\text{Circularity}=4\pi\times(\text{area}/\text{circumference}^2).$$

The circularity of toner is a value in a range of 0 to 1 where 1 represents a perfect sphere.

A toner particle distribution index may be a volume average particle diameter distribution coefficient (GSDv) or a number average particle diameter distribution coefficient (GSDp), which can be measured as described below.

First, a toner particle diameter distribution can be measured with a coulter multisizer II (Beckmann-coulter) meter. With respect to divided particle diameter ranges, that is, channels, a cumulative distribution of the toner particle diameter distribution with respect to volume and number of each toner particle is drawn starting from small-particle-diameter particles. A cumulative 16% volume average particle diameter is denoted by D16v, and a cumulative 16% number average particle diameter is denoted by D16p. A cumulative 50% volume average particle diameter is denoted by D50v, and a cumulative 50% number average particle diameter is denoted by D50p. A cumulative 84% volume average particle diameter is denoted by D84v, and a cumulative 84% number average particle diameter is denoted by D84p. GSDv is defined by D84v/D16v and GSDp is defined by D84p/D16p.

Each of GSDv and GSDp may be, for example, about 1.25 or less, specifically about 1.20 to about 1.25. If each of GSDv and GSDp is greater than about 1.25, particle diameters of toner may be non-uniform.

In the method, the primary latex may be polyester, a polymer synthesized by polymerizing at least one polymerizable monomer, or a mixture of these; i.e. hybrid. If the primary latex is a polymer, a releasing agent, such as wax, can be used when at least one polymerizable monomer is polymerized, or after at least one polymerizable monomer is polymerized.

Herein, the polymerization can be emulsion polymerization and the diameter of the primary latex synthesized by the emulsion polymerization may be, for example, about 1 μm or less, specifically in a range of about 100 to about 300 nm.

The polymerizable monomer may include at least one monomer selected from the group consisting of a styrene-based monomer, such as styrene, vinyl toluene, or α-methylstyrene; acrylic acid, meth acrylic acid; a derivative of (meth) acrylate, such as methyl acrylate, ethyl acrylate, propyl acrylate, butyl acrylate, 2-ethylhexyl acrylate, dimethylaminoethyl acrylate, methyl meth acrylate, ethyl meth acrylate, propyl meth acrylate, butyl meth acrylate, 2-ethylhexyl meth acrylate, dimethylaminoelhyl meth acrylate, acrylonitrile, methacrylonitrile, acrylamide, or methacrylamide; ethylene-containing unsaturated mono-olefins, such as ethylene, propylene, or bultylene; halogenated vinyl, such as vinyl chloride, vinylidene chloride, or vinyl fluoride; vinyl esters, such as vinyl acetate or vinyl propionic acid; vinyl ethers, such as vinylmethylether or vinylethylether; vinyl ketones, such as vinylmethyl ketone or methylisoprophenyl ketone; and a nitrogen-containing vinyl compound, such as 2-vinylpyridine, 4-vinylpyridine, or N-vinylpyrrolidone.

The primary latex can be prepared by performing a polymerization reaction in the presence of a polymerization initiator and a chain-transfer agent. Use of the polymerization initiator and the chain-transfer agent improves polymerization efficiency. Examples of the polymerization initiator include persulfates, such as potassium persulfate or ammonium persulfate; an azo compound, such as 4,4-azobis(4-cyano valeric acid), dimethyl-2,2'-azobis(2-methylproplonate), 2,2-azobis(2-amidinopropan)dihydrochloride, 2,2-azobis-2-methyl-N-1,1-bis(hydroxymethyl)-2-hydroxyethylpropioamide, 2,2'-azobis(2,4-dime thylvaleronitril), 2,2'-azobisisobutylonitrile, or 1,1'-azobis(1-cyclohexanecarbonitrile); and peroxides, such as methylethylperoxide, di-t-butylperoxide, acetylperoxide, dikumylperoxide, lauroylperoxide, benzoylperoxide, t-butylperoxy-2-ethylhexanoate, di-isopropylperoxydicarbonate, or di-t-butylperoxyisophthalate. The polymerization initiator can also be a combination of these compounds described above and a reducing agent, that is, an oxidation-reduction initiator.

In general, a chain-transfer agent refers to a material that changes a type of chain carrier in a chain reaction. That is, a new chain is less active than an old chain. By using a chain-transfer agent, the level of polymerization of a polymerizable monomer can be reduced, a new chain can be initiated, and distribution of molecular weights can be controlled.

The amount of the chain-transfer agent may be about 0.5 to about 5.0 parts by weight, specifically about 1.0 to about 4.0 parts by weight, based on 100 parts by weight of at least one polymerizable monomer. If the amount of the chain-transfer agent is less than about 0.5 parts by weight based on 100 parts by weight of one polymerizable monomer, the molecular weight of the obtained polymer may be too high. On the other hand, if the amount of the chain-transfer agent is greater than about 5.0 parts by weight based on 100 parts by weight of one polymerizable monomer, the molecular weight of the obtained polymer may be too low. Examples of a chain-transfer agent include a sulfur-containing compound, such as dodecanethiol, thioglycolic acid, thioacetic acid or mercaptoethanol; phosphorous acids, such as phosphoric acid or sodium phosphite; hypophosphorous acids, such as hypophosphoric acid or sodium hyphosphite; and alcohols, such as methylalcohol, ethylalcohol, isopropylalcohol, or n-butylalcohol. However, the chain-transfer agent is not limited to those compounds described above.

The primary latex may further include a charge controller. In the current embodiment, the charge controller can be a negative-polarity charge controller or a positive-polarity charge controller. Examples of a negative-polarity charge controller include a chromium-containing azo dye; a monoazo metal complex; a chromium, iron, or zinc-containing salicylic acid compound; and an organometallic complex, such as aromatic hydroboxylic acid or aromatic dicarboxylic acid. The negative-polarity charge controller can be any negative-polarity charge controller that is known in the art. Examples of a positive-polarity charge controller include a product modified with nigrosine or a fatty acid metal salt thereof, an onium salt including a quaternary ammonium salt, such as tributylbenzylammonium 1-hydroxy-4-naphtosulfonate, or tetrabutylammonium tetrafluoroborate; and a combination thereof. The charge controller stably supports toner on a development roller with static electricity and, thus, stable charging can be obtained with a short charging rate.

The primary latex obtained as described above is mixed with the pigment-dispersed solution and the releasing agent-dispersed solution. The pigment-dispersed solution can be obtained by homogeneously dispersing a composition including an emulsifier and a pigment with an ultrasonic dispersing device or a micro fluidizer, wherein the pigment includes a black pigment and a color pigment. In the pigment-dispersed solution, the black pigment can be carbon black or aniline black, and the color pigment can include at least one pigment selected from a yellow pigment, a magenta pigment, and a cyan pigment.

Examples of the yellow pigment include a condensed nitrogen compound, an isoindolinone compound, an anthraquine compound, an azo metal complex, and an alryl imide compound. Specifically, examples of the yellow pigment include C.I. pigment yellows 12, 13, 14, 17, 62, 74, 83, 93, 94, 95, 109, 110, 111, 128, 129, 147, 168, and 180.

Examples of the magenta pigment include a condensed nitrogen compound, anthraquine, a quinacridone compound, a base dye late compound, a naphthol compound, a benzo imidazol compound, a thioindigo compound, and perylene compound. Specifically, examples of the magenta pigment include C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254.

Examples of the cyan pigment include a copper phthalocyanine compound, a derivative thereof, an anthraquine compound, and a base dye late compound. Examples of the cyan pigment include C.I. pigment blues 1, 7, 15, 15:1, 15:2, 15:3, 15:4, 60, 62, and 66.

The aforementioned pigments can be used alone or in combinations, in consideration of color, chromaticity, brightness, weather resistance characteristics, and dispersing characteristics with respect to toner.

The pigments described above may be used in an amount sufficient to colorize toner. In this regard, the amount of the pigment may be, for example, in a range of 0.1-20 parts by weight based on 100 parts by weight of at least one polymerizable monomer. If the amount of the pigment is less than 0.1 parts by weight based on 100 parts by weight of the polymerizable monomer, a sufficient coloring effect may not be obtained. On the other hand, if the amount of the pigment is greater than 20 parts by weight based on 100 parts by weight of the polymerizable monomer, the manufacturing costs of toner are increased and the amount of static electricity may be reduced.

The emulsifier in the pigment-dispersed solution can be any known emulsifier. The emulsifier can be an anionic-reactive emulsifier, a non-ionic reactive emulsifier, or a mixture thereof. The anionic reactive emulsifier may be HS-10 (Dai-ich kogyo Co.) or Dawfax 2-Al (Rhodia Co.). The non-ionic reactive emulsifier may be RN-10 (Dai-ichi kogyo Co.).

The releasing agent-dispersed solution used in the method of preparing toner includes a releasing agent, water, and an emulsifier. Due to the releasing agent, toner can be fixed onto a final image receptor at low temperature and can form a durable and anti-abrasive image. Therefore, characteristics of toner are dependent upon the type and amount of the releasing agent. Examples of the releasing agent include polyethylene-based wax, polypropylene-based wax, silicon wax, paraffin-based wax, ester-based wax, carnauba wax, and metallocene wax. Examples of the releasing agent include an ester group-containing wax. The ester group-containing wax may be a mixture of an ester-based wax and a non-ester based wax, or an ester group-containing non-ester based wax. However, the releasing agent is not limited to these waxes. The melting point of the releasing agent may be, for example, in a range of about 50 to about 150° C. The releasing agent is adhered to the primary latex but is not covalently bonded thereto.

The amount of the releasing agent may be, for example, in a range of about 1 to about 20 parts by weight, specifically about 5 to about 10 parts by weight, based on 100 parts by weight of at least one polymerizable monomer. If the amount of the releasing agent is less than about 1 part by weight based on 100 parts by weight of at least one polymerizable monomer, low-temperature fixing characteristics may be degraded and a fixing temperature range is narrow. On the other hand, if the amount of the releasing agent is greater than about 20 parts by weight based on 100 parts by weight of at least one polymerizable monomer, the toner may not be preserved and may be expensive.

An ester group and a non-ester based wax are used simultaneously so the ester group has high affinity with respect to latex of toner. Thus, wax can be uniformly dispersed among toner particles, and the non-ester based wax can prevent excess plasticizing from occurring due to releasing when only ester-based wax latex is used. Therefore, the above-described simultaneous use leads to favorable long-term development characteristics of toner.

The ester-based wax may be an ester of a $C_{15-30}$ fatty acid or an ester of a 1-5 valent alcohol. Specifically, examples of the ester of a $C_{15-30}$ fatty acid include behenyl behenic acid, stearyl stearate, ester stearate of pentaeritritol, and glyceride montanate. In addition, in ester, an alcohol component can be a monovalent alcohol or a polyhydric alcohol. If the alcohol component in ester is a monovalent alcohol, the number of carbon atoms in the alcohol may be in a range of about 10 to about 30. If the alcohol component in ester is a polyhydric alcohol, the number of carbon atoms in the alcohol may be in a range of about 3 to about 10. Examples of the non-ester based wax include polyethylene-based wax and paraffin wax.

The ester group-containing wax may be a mixture of a paraffin-based wax and an ester-based wax; or an ester group-containing paraffin-based wax. Specifically, examples of the ester group-containing wax include P-280, P-318, and P-319, which are produced by Chukyo Yushi, Co. Ltd.

The amount of the ester group in the releasing agent may be in a range of about 2 to about 10% by weight based on the total weight of the releasing agent. If the amount of the ester group is less than about 2% by weight based on the total weight of the releasing agent, it may not be as compatible with latex. On the other hand, if the amount of the ester group is greater than about 10% by weight based on the total weight of the releasing agent, the toner may become too plasticized and may not develop properly.

Like the emulsifier used in the pigment-dispersed solution, the emulsifier used in the releasing agent-dispersed solution can be any emulsifier that is used in the art. In this regard, the emulsifier used in the releasing agent-dispersed solution may be an anionic reactive emulsifier, a non-ionic reactive emulsifier, or a mixture thereof. Examples of the anionic reactive emulsifier may include HS-10 (manufactured by Dai-ich kogyo) and Dawfax 2-Al (manufactured by Rhodia Co.). Examples of the non-ionic reactive emulsifier include RN-10 (manufactured by Dai-ichi kogyo Co.).

Through the method described above, the molecular weight and $T_g$ of the toner are adjusted to be suitable for low temperature fixing, and rheological characteristics of the toner are also controlled.

The primary latex prepared as described above, the pigment-dispersed solution prepared as described above, and the releasing agent-dispersed solution prepared as described above, are mixed. Then, an aggregating agent is added to the mixture to obtain agglomerated toner. Specifically, the primary latex, the pigment-dispersed solution, and the releasing agent-dispersed solution are mixed and then an aggregating agent is added thereto in a condition of pH of 1-4 to form once-agglomerated toner having a diameter of 2.5 μm. Herein, once-agglomerated toner functions as a core. Then, secondary latex is added to the once-agglomerated toner and the pH of the resultant solution is adjusted to be in a range of 6-8. When the particle size is maintained constant for a predetermined time period, the temperature is increased to a range of 90-96° C. and the pH is decreased to a range of 5.8-6. Therefore, twice-agglomerated toner can be prepared. The aggregating agent may include one or more Si and Fe-containing metal salts. Examples of the Si and Fe-containing metal salt include polysilica iron.

The secondary latex can be prepared by polymerizing at least one polymerizable monomer described above. The polymerization may be emulsion-polymerization. The particle diameter of the secondary latex may be, for example, about 1 μm or less, specifically in a range of about 100 to about 300 nm. The secondary latex can also include wax. The wax may be included in the secondary wax when the secondary latex is formed by polymerizing. The twice-agglomerated toner can be further coated with tertiary latex prepared by polymerizing at least one polymerizable monomer described above.

Each of the secondary latex and the tertiary latex constitutes a shell layer. Due to the secondary latex and the tertiary latex, the toner has high durability, and good preservation characteristics when shipping and handling. In some cases, a polymerization inhibitor can be further used to prevent formation of other types of latex. In addition, the formation of the shell layer may be performed using a starved-feed process to obtain high coating efficiency.

The twice-agglomerated toner prepared as described above or the thrice-agglomerated toner prepared as described above is filtered and toner particles are isolated. The isolated toner particles are then dried. Then, an external additive is added to the dried loner and the resultant toner is appropriately charged, thereby obtaining final dry toner.

The external additive may be silica or $TiO_2$. The amount of the external additive may be, for example, in a range of about 1.5 to about 4 parts by weight, specifically about 2 to about 3 parts by weight, based on 100 parts by weight of external additive-free toner. If the amount of the external additive is less than about 1.5 parts by weight based on 100 parts by weight of external additive-free toner, toner particles may be attached to each other due to a cohesive force, known as a caking phenomenon, and the toner is non-uniformly charged. On the other hand, if the amount of the external additive is greater than about 4 parts by weight based on 100 parts by weight of external additive-free toner, excess external additive may contaminate a development roller.

An image forming method according to an embodiment of the present general inventive concept includes: attaching toner to a surface of a photoreceptor on which a latent image is formed so as to form a visible image; and transferring the visible image to a transfer medium, wherein the toner is an electrophotographic toner including latex, a colorant, and a releasing agent.

$$\left|\frac{d\eta}{dT}\right| |d(\log_{10}\eta)/dT|$$

of the electrophotographic toner in a temperature range of 100° C.-160° C. is in a range of about 0.03 to about 0.06 and complex viscosity (η) of the electrophotographic toner at 140° C. is in a range of about $1.0\times10^2$ Pa·s to about $6.0\times10^2$ Pa·s.

A representative electrophotographic image forming process includes a series of processes to form images on a receptor, including a charging process, a light-exposing process, a developing process, a transferring process, a fixing process, a cleaning process, and an erasing process.

In the charging process, a surface of a photoreceptor is charged with negative or positive charges, whichever is desired, by a corona or a charge roller. In the light-exposing process, an optical system, conventionally a laser scanner or an array of diodes, selectively discharges the charged surface of the photoreceptor in an image-wise manner corresponding to a final visual image formed on a final image receptor to form a latent image. Electromagnetic radiation, which can be referred to as "light," includes infrared radiation, visible light radiation, and ultraviolet radiation.

In the developing process, appropriately-charged toner particles contact the latent image of the photoreceptor, and conventionally, an electrically-biased developer having identical potential polarity to the toner polarity is used. The toner particles move to the photoreceptor and are selectively attached to the latent image by static electricity, and form a toner image on the photoreceptor.

In the transferring process, the toner image is transferred to the final image receptor from the photoreceptor. In some cases, the transfer of the toner image to the final image receptor can be aided by an intermediate transferring element. In the fixing process, the toner image of the final image receptor is heated and the toner particles thereof are softened or melted, and, thus, the toner image is fixed to the final image receptor. Another way of fixing is to subject toner on the final image receptor to high pressure with or without the application of heat. In the cleaning process, residual toner remaining on the photoreceptor is removed.

Finally, in the erasing process, charges of the photoreceptor are exposed to light of a predetermined wavelength band and are reduced to be substantially uniform and of low value, and, thus, the residue of the latent image is removed and the photoreceptor is prepared for a next image forming cycle.

A cartridge may include toner, and a housing for containing the toner. Herein, the toner is an electrophotographic toner including latex, a colorant, and a releasing agent;

$$\left|\frac{d\eta}{dT}\right| |d(\log_{10}\eta)/dT|$$

of the electrophotographic toner in a temperature range of 100° C.-160° C. is in a range of about 0.03 to about 0.06; and complex viscosity (η) of the electrophotographic toner at 140° C. is in a range of about $1.0\times10^2$ Pa·s to about $6.0\times10^2$ Pa·s.

FIG. 1 is a perspective view of a cartridge 100. The cartridge 100 includes a toner tank 101, a supplier 103, a toner transferring member 105, and a toner stirring member 110. The toner tank 101 contains a predetermined amount of toner, and may be hollow-cylindrical.

The supplier 103 is installed in an inner lower part of the toner tank 101, and supplies toner contained in the toner tank 101. For example, the supplier 103 projects from the bottom of the toner tank 101 to the inside of the toner tank 101 in a pillar shape with a semi-circular section. A toner-discharge pore (not shown), through which toner is discharged, is formed in one end of the supplier 103. The toner transferring member 105 is formed in the inner lower part of the toner tank 101 and on a side of the supplier 103. The toner transferring member 105 is coil-spring shaped and one end of the toner transferring member 105 extends toward an inside of the supplier 103. Due to the structure of the toner transferring member 105, when the toner transferring member 105 rotates, toner contained in the toner tank 101 is transferred to the inside of the supplier 103 in a toner-supply direction denoted by an arrow A. The toner transferred by the toner transferring member 105 is discharged through the toner-discharge pore.

The toner stirring member 110 is rotatably installed inside the toner tank 101 and causes toner contained in the toner tank 101 to flow downward. That is, when the toner stirring member 110 rotates at the center of the toner tank 101, toner contained in the toner tank 101 is stirred and is not solidified and is thus moved downward due to its weight. The toner stirring member 110 includes a rotary shaft 112 and a toner stirring film 120. The rotary shaft 112 rotates at the center of the toner tank 101, and a driving gear (not shown) is installed on one end of the rotary shaft 112 protruding toward one side of the toner tank 101. Accordingly, when the driving gear rotates, the rotary shaft 112 rotates. That is, the driving gear and the rotary shaft 112 are integrally formed as one body and rotate at the same time. In addition, the rotary shaft 112 may include an alar plate 114 to easily install the toner stirring film 120. In this regard, the alar plate 114 may be symmetrical with respect to the rotary shaft 112. The toner stirring film 120 has a width corresponding to an inner length of the toner tank 101 and is elastic so that the toner stirring film 120 can be deformed corresponding to a protrusion inside the toner tank 101, that is, the supplier 103. The toner stirring film 120 may be cut to a predetermined length in a direction extending from an end of the toner stirring film 120 to the rotary shaft 112, thereby forming a first stirring portion 121 and a second stirring portion 122.

An apparatus for forming an image using toner includes a transferring unit for transferring a print medium, in which the toner is an electrophotographic toner including latex, a colorant, and a releasing agent;

$$\left|\frac{d\eta}{dT}\right| |d(\log_{10}\eta)/dT|$$

of the electrophotographic toner in a temperature range of 100° C.-160° C. is in a range of about 0.03 to about 0.06; and complex viscosity (η) of the electrophotographic toner at 140° C. is in a range of about $1.0\times10^2$ Pa·S to about $6.0\times10^2$ Pa·s.

Figure 2:
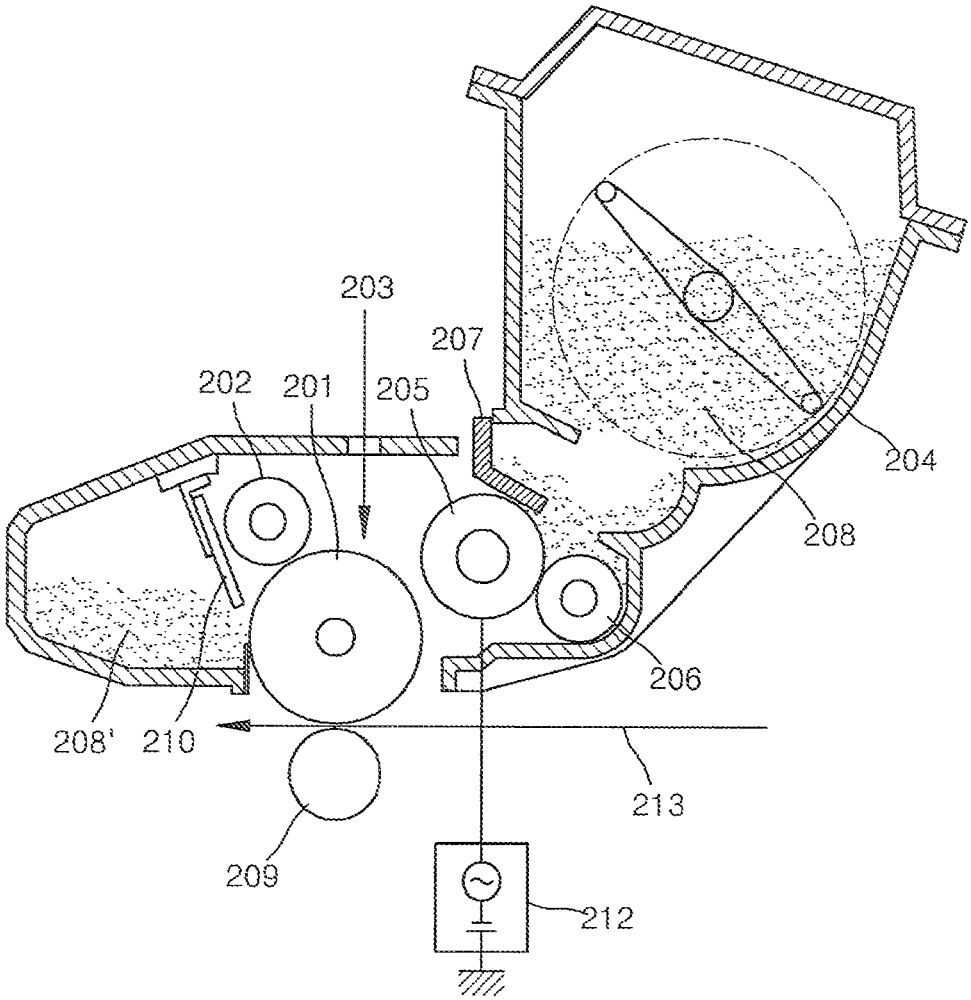
FIG. 2 is a cross-sectional view of an image forming apparatus including toner.

FIG. 2 is a cross-sectional view of an image forming apparatus including toner. A non-magnetic one-component developer 208 of a development device 204 is supplied onto a development roller 205 by a supply roller 206. The supply roller 206 may be formed of an elastic material, such as polyurethane foam or sponge. Then, the non-magnetic one-component developer 208 reaches a contact portion between a developer controlling blade 207 and the development roller 205 when the development roller 205 rotates. The developer controlling blade 207 may be formed of an elastic material, such as metal or rubber. When the non-magnetic one-component developer 208 passes through the contact portion between the developer controlling blade 207 and the development roller 205, the non-magnetic one-component developer 208 is formed into a uniform film and sufficiently charged. The film of the non-magnetic one-component developer 208 is transferred to a development area of a photoreceptor 201, which is a latent image carrier, by the development roller 205, so that a latent image in the development area is developed. In this regard, the latent image is formed by irradiating light 203 to the photoreceptor 201.

The development roller 205 faces the photoreceptor 201 and is spaced apart from the photoreceptor 201 by a predetermined distance. The development roller 205 rotates in a counter-clockwise direction and the photoreceptor 201 rotates in a clockwise direction.

The non-magnetic one-component developer 208 transferred to the development area of the photoreceptor 201 develops the latent image formed on the photoreceptor 201 by an electric force and thus a toner image is formed. Herein, the electric force is generated due to a potential difference between a direct current (DC)-accompanied alternative current (AC) voltage applied to the development roller 205 and a potential of the latent image on the photoreceptor 201 charged by a charging member 202.

The non-magnetic one-component developer 208 on the photoreceptor 201 reaches a transfer member 209 according to a rotation direction of the photoreceptor 201. The transfer member 209 may be roller-shaped. The non-magnetic one-component developer 208 on the photoreceptor 201 is transferred to a print medium 213 by the transfer member 209 due to a corona discharge, or a high voltage of opposite polarity to that of the non-magnetic one-component developer 208 is applied to the transfer member 209 when the print medium 213 passes by the transfer member 209.

The image transferred to the print medium 213 is fused on the print medium 213 when the non-magnetic one-component developer 208 passes through a high-temperature and a high-pressure fusing device (not shown). Meanwhile, residue developer 208' on the development roller 205 is recollected by the supply roller 206 contacting the development roller 205, and the residue developer 208' on the photoreceptor 201 is recollected by a cleaning blade 210. These image-forming operations described above may be repeatedly performed.

The following examples are for illustrative purposes only and are not intended to limit the scope of the disclosure. The shape of toner was identified using scanning electron microscopy (SEM). Specifically, 50 SEM toner images were selected and circularity of toner was measured using software Image J and software 1.33u (National Institute of Health, USA) that are used for quantifying images.

Equation $$\text{Circularity}=4\pi\times\text{area}/\text{circumference}^2$$

The value of circularity is in a range of 0-1, 1 representing a substantially perfect sphere.

EXAMPLE 1

Synthesis of Primary Latex

A monomer mixture including 970 g of styrene, 129 g of n-butyl acrylate, and 36 g of β-carboxylethylacrylate (produced by Sipomer, Rhodia); 4.2 g of α-decandiol diacrylate (produced by Shin-nakamura chemical) functioning as a crosslinking agent; and 18.8 g of dodecanthiol (produced by Aldrich) functioning as a chain-transfer agent (CTA) were added to a 3 L beaker, and then 500 g of an aqueous solution of 2% sodium dodecyl sulfate (produced by Aldrich) functioning as an emulsifier were added thereto and stirred altogether to prepare a monomer emulsified solution. 18 g of a polymerization initiator and 1160 g of an aqueous solution of 0.13% sodium dodecyl sulfate (produced by Aldrich) functioning as an emulsifier were added to a 3 L double jacket reactor which had been heated to 75° C. Then, the prepared monomer emulsified solution was gradually introduced, drop-wise for at least two hours while stirring. The reaction was performed at a reaction temperature for 8 hours. Sizes of obtained latex particles were measured using a light scattering method (Horiba 910) at a wavelength of 150-200 nm.

Preparation of Pigment-Dispersed Solution 10 g of a mixture of an anionic reactive emulsifier (HS-10; DAI-ICH KOGYO) and a non-ionic reactive emulsifier (RN-10; DAI-ICH KOGYO) in a mixture ratio of 80:20, and 60 g of black pigment (Cabot Corp., Mogul-L) were added to a milling bath. Then, 400 g of glass beads having a diameter of 0.8-1 mm were added thereto and a milling operation was performed with a dispersing device at room temperature to prepare a pigment-dispersed solution. The dispersing device was an ultrasonic-wave dispersing device (Sonic and materials, VCX750).

Agglomeration and Preparation of Toner 500 g of deionized water, 150 g of the obtained latex functioning as a core, 35 g of cyan pigment-dispersed solution (HS-10 100%), and 27 g of wax-dispersed solution P-280 (produced by Chukyo Yushi, Co. Ltd.) were added to a 1 L reactor Then, a mixture including 15 g (0.3 mol) of nitric acid and 136.4 g of 11% PSI-025 solution (produced by Suido Kiko Kaisha. Ltd) functioning as an aggregating agent (a solid content was 15 g) was added to the reactor and the resultant mixture was stirred with a homogenizer at a rotation rate of 11,000 rpm for 6 minutes. As a result, once-agglomerated toner having a volume average particle diameter of 1.5-2.5 μm was manufactured. The resultant mixture was added to a double jacket reactor for a 1 L beaker and the temperature was increased starting from room temperature to 50° C. ($T_g$ of latex −5° C.) at a rate of 0.02° C. per minute. When a percentage of the once-agglomerated toner particles having a volume particle diameter of about 5.5 μm or less based on all of the once-agglomerated toner particles was 2% or less, 50 g of secondary latex prepared by polymerizing polystyrene-based polymerizable monomer was further added to the once-agglomerated toner. When the volume average particle diameter of the once-agglomerated toner was 6.0 μm, 1 mol of NaOH was added thereto to control the pH to 7. When the volume average particle diameter was maintained constant for 10 minutes, the temperature was increased to 96° C. at a rate of 0.5° C./min. When the temperature reached 96° C., 0.3 mol of nitric acid was added to the once-agglomerated toner to lower the pH to 6.6 and the once-agglomerated toner was coalesced for 3-6 hours. As a result, a potato-shaped twice-agglomerated toner having a volume average particle diameter of 5-6 μm was obtained. Then the reaction product was cooled to a temperature lower than $T_g$ and a filtering operation was performed to separate toner particles. Then the toner particles were dried.

0.5 parts by weight of NX-90 (produced by Nippon Aerosil), 1.0 part by weight of RX-200 Nippon Aerosil, 0.5 parts by weight of SW-100 (produced by Titan Kogyo) were added to 100 parts by weight of the dried toner particles. The mixture was stirred with a mixer (KM-LS2K, produced by DacWhaTech) at a rotation rate of 3,000 rpm for 5 minutes. Toner having a volume average particle diameter of 5.8 μm was obtained. GSDp and GSDv of the toner were 1.23 and 1.22, respectively. Circularity of the toner was 0.950.

EXAMPLE 2

Toner was prepared in the same manner as in Example 1, except that 11.35 g of 1-dodecanthiol functioning as a CTA was used. As a result, toner having a volume average particle diameter of 5.6 μm was obtained. GSDp and GSDv of the toner were 1.23 and 1.21, respectively. Circularity of the toner was 0.950.

EXAMPLE 3

Toner was prepared in the same manner as in Example 1, except that 22.7 g of 1-dodecanthiol functioning as a CTA was used. Toner having a volume average particle diameter of 5.9 μm was obtained. GSDp and GSDv of the toner were 1.23 and 1.21, respectively. Circularity of the toner was 0.940.

EXAMPLE 4

Toner was prepared in the same manner as in Example 1, except that 34.05 g of 1-dodecanthiol functioning as a CTA was used. Toner having a volume average particle diameter of 6.0 μm was obtained. GSDp and GSDv of the toner were 1.22 and 1.20, respectively. Circularity of the toner was 0.950.

EXAMPLE 5

Toner was prepared in the same manner as in Example 1, except that 63.6 g of 11% PSI-025 solution (solid content was 7 g) functioning as an aggregating agent was used. Toner having a volume average particle diameter of 5.9 μm was obtained. GSDp and GSDv of the toner were 1.24 and 1.21, respectively. Circularity of the toner was 0.960.

EXAMPLE 6

Toner was prepared in the same manner as in Example 1, except that 90.9 g of 11% PSI-025 solution (solid content was 10 g) functioning as a aggregating agent was used. Toner having a volume average particle diameter of 5.8 μm was obtained. GSDp and GSDv of the toner were 1.22 and 1.20, respectively. Circularity of the toner was 0.950.

EXAMPLE 7

Toner was prepared in the same manner as in Example 1, except that 163.6 g of 11% PSI-025 solution (solid content was 18 g) functioning as a aggregating agent was used. Toner having a volume average particle diameter of 6.0 as obtained. GSDp and GSDv of the toner were 1.23 and 1.20 respectively. Circularity of the toner was 0.950.

COMPARATIVE EXAMPLE 1

Toner was prepared in the same manner as in Example 1, except that 56.76 g of 1-dodecanthiol functioning as a CTA was used. Toner having a volume average particle diameter of 6.0 μm was obtained. GSDp and GSDv of the toner were 1.25 and 1.20, respectively. Circularity of the toner was 0.940.

COMPARATIVE EXAMPLE 2

Toner was prepared in the same manner as in Example 1, except that 5.676 g of 1-dodecanthiol functioning as a CTA was used. Toner having a volume average particle diameter of 5.8 μm was obtained. GSDp and GSDv of the toner were 1.23 and 1.20, respectively. Circularity of the toner was 0.960.

COMPARATIVE EXAMPLE 3

Toner was prepared in the same manner as in Example 1, except that 9.1 g of 11% PSI-025 solution (solid content was 1 g) functioning as an aggregating agent was used. Toner having a volume average particle diameter of 6.2 μm was obtained. GSDp and GSDv of the toner were 1.26 and 1.20, respectively. Circularity of the toner was 0.980.

COMPARATIVE EXAMPLE 4

Toner was prepared in the same manner as in Example 1, except that 272.7 g of 11% PSI-025 solution (solid content was 30 g) functioning as an aggregating agent was used. Toner having a volume average particle diameter of 6.5 μm was obtained. GSDp and GSDv of the toner were 1.27 and 1.22, respectively. Circularity of the toner was 0.976.

Evaluation of Toner

Complex Viscosity Test

The complex viscosity of toner was measured with an ARES rheometer manufactured by Rheometric Scientific Co. Toner was loaded in a linear region between two circular plates having a diameter of 8 mm, and complex viscosity of the toner was measured every 30 minutes in a temperature range of 40° C. to 180° C., increasing the temperature by 2-3° C./min. While the complex viscosity was measured, the temperature error range was controlled to be within 1° C. to increase the level of accuracy.

FIG. 3 is a graph of storage/loss modulus with respect to loss tangent of the toner prepared according to Example 1.

Figure 4:
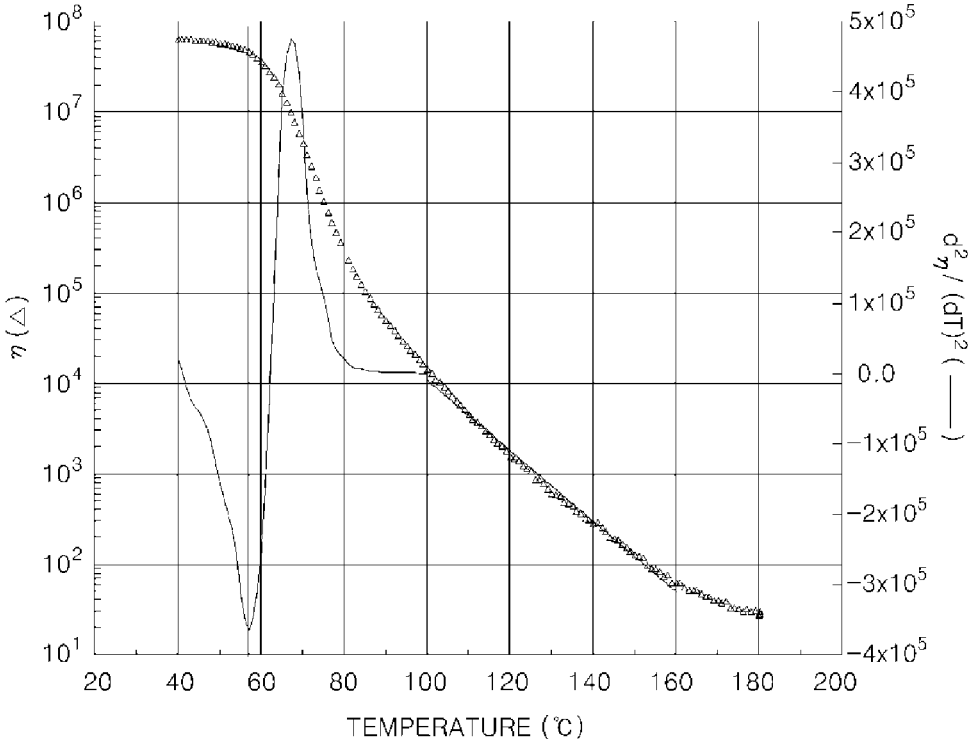
FIG. 4 shows a graph of a complex viscosity and a secondary differential graph of the complex viscosity with respect to temperature of toner manufactured according to Example 1.

FIG. 4 shows a graph of a complex viscosity and a secondary differential graph of the complex viscosity with respect to temperature of toner manufactured according to Example 1.

Evaluation of Fixing Characteristics

Equipment: Belt-type fixing device (manufacturer: Samsung Electronics, Product Name: Color Laser Printer, Model No. CLP-660)

un-fixed image for the test: 100% pattern test temperature: 100-200° C. (temperature increase rate of 10° C.)

fixing rate: 160 mm/sec fixing time: 0.08 sec

A fixing test was performed under the conditions described above and fixing characteristics of the fixed image were evaluated using the method described as follows. Optical density (OD) of the fixed image was measured, and then 3M 810 tape was attached to the fixed image. A 500 g weight was applied to the tape and moved up and down five times, and then the tape was peeled off. The OD of the fixed toner was measured.

Fixing characteristics value (%)=(OD_after the tape was peeled off/OD_before the tape was peeled off)×100. A toner fixing temperature range is a fixing temperature range in which the fixing characteristics value was 90% or more. MFT: minimum fusing temperature [a lowest temperature at which the fixing characteristics value is 90% or more without cold-offset] HOT: hot offset temperature [a lowest temperature at which hot-offset occurs]

Evaluation of Gloss

A glossmeter (manufacturer: BYK Gardner, product name: micro-TR1-gloss) was used at the fixing temperature of 160° C.

Test angle: 60°

Test pattern: 100% pattern

High-Temperature Package-Stability Evaluation 100 g of toner was loaded into a developing unit (manufacturer: Samsung Electronics, product name: color laser 660) and then the developing unit was packaged and left to sit in an oven while the temperature and humidity were adjusted to be constant. Test conditions were as follows:

23° C., 55% relative humidity (RH) 2 hours

=>40° C., 90% RH 48 hours

>50° C., 80% RH 48 hours

=>40° C., 90% RH 48 hours

=>23° C., 55% RH 6 hours

Then, it was identified with the naked eye whether toner in the developing unit was caked. Next, a 100% image was printed out and the level of image defects was evaluated.

Evaluation Standard

○: good image and no-caking

Δ: bad image and no-caking

X: caking

Streak Test

Durability was evaluated with a streak test. To perform the streak test, a 0% image was printed on 500 sheets under operating conditions of 20 PPM using a color laser printer (manufacturer: Samsung Electronics, product name: color laser 660 model) and then formation of streaks was identified. The test results are denoted by ○, Δ, and X in Table 2 below.

○: no contamination occurred;

Δ: contamination occurred but image was not affected; and

X: contamination occurred and image was affected.

Evaluation on Amount of Fe

Toner powder was formed into a sample having a diameter of 25 mm and a thickness of 3 mm using a 25 mm press mold, and the prepared sample was measured with XRF equipment (Shimadzu, EDAX-720).

The electrophotographic toner can be formed by efficiently agglomerating a small amount of toner forming materials at low temperature. Therefore, residue of toner is small and thus, the toner is virtually harmless to human beings and the environment.

While the present disclosure has been particularly shown and described, it will be understood by those of ordinary skill in the art that various changes in form and details may be made therein without departing from the spirit and scope defined by the following claims.

What is claimed is:

1. An electrophotographic toner comprising:

latex;

a colorant; and a releasing agent comprising an ester group, an amount of the ester group in the releasing agent being in a range of about 2 to about 10% by weight based on the total weight of the releasing agent, wherein the absolute value of a differential value of complex viscosity with respect to temperature, $$\left|\frac{d\eta}{dT}\right|,$$

TABLE 2

| | Rheological characteristics | | | | | Fixing characteristics | | | Durability | | |
|---|---|---|---|---|---|---|---|---|---|---|---|
| | Complex viscosity differential value ($d(\log_{10}\eta^*)/dT$) | $\eta^*$ (Pa*s) @$d^2(\log_{10}\eta^*)/(dT)^2$ minimum | $\eta^*$ Pa*s @ tan δ local minimum value | Activated energy (KJ/mol) | $\eta^*$ @140° C. | MFT ° C. | Tape test % | Gloss Level [60°] | High-temperature packaging stability | Streak | XRF Fe amount (ppm) |
| Example 1 | −0.042 | $3.4\times10^7$@55° C. | $2.9\times10^4$@89° C. | 184 | 350 | 120 | 94 | 11.4 | ○ | ○ | 3900 |
| Example 2 | −0.035 | $3.7\times10^7$@59° C. | $3.8\times10^4$@89° C. | 171 | 590 | 130 | 95 | 10.7 | ○ | ○ | 3800 |
| Example 3 | −0.038 | $3.1\times10^7$@51° C. | $2.7\times10^4$@86° C. | 188 | 495 | 120 | 98 | 10.9 | ○ | ○ | 4100 |
| Example 4 | −0.034 | $3.5\times10^7$@57° C. | $2.9\times10^4$@88° C. | 179 | 550 | 130 | 93 | 10.5 | ○ | ○ | 3800 |
| Example 5 | −0.033 | $3.5\times10^7$@56° C. | $2.8\times10^4$@88° C. | 180 | 500 | 120 | 94 | 10.0 | ○ | ○ | 1500 |
| Example 6 | −0.035 | $3.2\times10^7$@53° C. | $2.9\times10^4$@90° C. | 186 | 420 | 120 | 94 | 10.2 | ○ | ○ | 2100 |
| Example 7 | −0.051 | $3.7\times10^7$@55° C. | $3.5\times10^4$@89° C. | 195 | 320 | 130 | 95 | 11.2 | ○ | ○ | 8200 |
| Comparative Example 1 | −0.027 | $2.8\times10^7$@48° C. | $2.1\times10^4$@82° C. | 173 | 290 | 110 | 98 | 10.1 | x | Δ | 4100 |
| Comparative Example 2 | −0.025 | $4.5\times10^7$@61° C. | $5.1\times10^4$@88° C. | 169 | 1442 | 140 | 85 | 3.5 | ○ | ○ | 3800 |
| Comparative Example 3 | −0.018 | $4.8\times10^7$@71° C. | $5.0\times10^4$@91° C. | 140 | 1300 | 120 | 82 | 5.8 | x | Δ | 45 |
| Comparative Example 4 | −0.065 | $3.5\times10^7$@50° C. | $3.4\times10^4$@91° C. | 230 | 246 | 120 | 95 | 11.5 | Δ | ○ | 12500 |

In Table 2, "$\eta^*$ (Pa*s) @$d^2(\log_{10}\eta^*)/(dT)^2$ minimum" refers to complex viscosity of toner at a temperature at which $d^2(\log_{10}\eta^*)/(dT)^2$ is smallest. "$\eta^*$ (Pa*s) @tan δ local minimum value" refers to the complex viscosity of toner at a temperature at which loss tangent of toner, that is, tan δ (=G"/G', a ratio of loss modulus G" to storage modulus G') has a local minimum value.

Referring to Table 2, $$\left|\frac{d\eta}{dT}\right| |d(\log_{10}\eta)/dT|$$

of the toners prepared according to Examples 1-7 was in a range of about 0.03 to about 0.06. Therefore, it can be seen that, compared to the toners prepared according to Comparative Examples 1-4, the toners prepared according to Examples 1-7 have appropriate viscosity in a temperature range of a fixing condition and thus, have excellent fixing characteristics and durability. Further, it has rheological characteristics that are optimized to form high-gloss images.

of the electrophotographic toner in a temperature range of about 100° C. to about 160° C. is in a range of about 0.03 to about 0.06, and complex viscosity (η) of the electrophotographic toner at 140° C. is in a range of about $1.0\times10^2$ Pa·s to about $6.0\times10^2$ Pa·s.

2. The electrophotographic toner of claim 1, wherein the complex viscosity of the electrophotographic toner at a temperature at which tan δ has a local minimum value is in a range of about $1.0\times10^4$ Pa·s to about $4.0\times10^4$ Pa·s, and an activation energy of the electrophotographic toner is about 170 KJ/mol or more.

3. The electrophotographic toner of claim 2, wherein the temperature at which tan δ of the electrophotographic toner has the local minimum value is in a range of about 80 to about 90° C.

4. The electrophotographic toner of claim 1, wherein the complex viscosity of the electrophotographic toner at a temperature at which $d^2\eta/(dT)^2$ is minimal is about $3.0\times10^7$ Pa·s or more.

5. The electrophotographic toner of claim 4, wherein the temperature at which $d^2\eta/(dT)^2$ is minimal is in a range of about 50 to about 70° C.

6. The electrophotographic toner of claim 1, further comprising about 50 to about 10,000 ppm of Fe with respect to the electrophotographic toner.

7. The electrophotographic toner of claim 1, wherein the releasing agent comprises a mixture of a paraffin-based wax and an ester-based wax or an ester group-containing paraffin-based wax.

8. The electrophotographic toner of claim 1, wherein the average diameter of the electrophotographic toner is in a range of about 3 to about 9 μm.

9. The electrophotographic toner of claim 1, wherein the average circularity of the electrophotographic toner is in a range of about 0.940 to about 0.980.

10. The electrophotographic toner of claim 1, wherein each of a volume average particle diameter distribution coefficient (GSDv) and a number average particle diameter distribution coefficient (GSDp) of the electrophotographic toner is about 1.25 or less.

* * * * *